US006612917B2

(12) United States Patent
Bruxvoort

(10) Patent No.: US 6,612,917 B2
(45) Date of Patent: Sep. 2, 2003

(54) ABRASIVE ARTICLE SUITABLE FOR MODIFYING A SEMICONDUCTOR WAFER

(75) Inventor: Wesley J. Bruxvoort, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/778,530

(22) Filed: Feb. 7, 2001

(65) Prior Publication Data

US 2002/0106980 A1 Aug. 8, 2002

(51) Int. Cl.[7] ..... B24D 11/00
(52) U.S. Cl. ..... 451/533; 451/552
(58) Field of Search ..... 451/526, 527, 451/528, 529, 530, 533, 537, 538, 539, 552, 553, 41

(56) References Cited

U.S. PATENT DOCUMENTS

| | | | | |
|---|---|---|---|---|
| 4,244,775 A | | 1/1981 | D'Asaro | |
| 4,374,077 A | | 2/1983 | Kerfeld | |
| 4,576,850 A | | 3/1986 | Martens | |
| 4,588,258 A | | 5/1986 | Hoopman | |
| 4,606,154 A | * | 8/1986 | Herrmann et al. | 451/526 |
| 5,020,283 A | | 6/1991 | Tuttle | |
| 5,109,638 A | * | 5/1992 | Kime, Jr. | 451/539 |
| 5,177,908 A | | 1/1993 | Tuttle | |
| 5,183,597 A | | 2/1993 | Lu | |
| 5,212,910 A | | 5/1993 | Breivogel et al. | |
| 5,230,184 A | | 7/1993 | Bukhman | |
| 5,287,663 A | | 2/1994 | Pierce et al. | |
| 5,489,233 A | | 2/1996 | Cook et al. | |
| 5,575,707 A | | 11/1996 | Talieh et al. | |
| 5,607,341 A | | 3/1997 | Leach | |
| 5,609,517 A | | 3/1997 | Lofaro | |
| 5,692,950 A | | 12/1997 | Rutherford et al. | |
| 5,733,178 A | | 3/1998 | Ohishi | |
| 5,897,424 A | | 4/1999 | Evans et al. | |
| 5,897,930 A | | 4/1999 | Calhoun et al. | |
| 5,958,794 A | | 9/1999 | Bruxvoort et al. | |
| 5,975,988 A | * | 11/1999 | Christianson | 451/28 |
| 6,007,407 A | | 12/1999 | Rutherford et al. | |
| 6,022,264 A | | 2/2000 | Cook et al. | |
| 6,059,850 A | * | 5/2000 | Lise et al. | 51/295 |
| 6,206,759 B1 | | 3/2001 | Agarwal et al. | |
| 6,217,426 B1 | * | 4/2001 | Tolles et al. | 451/285 |
| 6,234,875 B1 | * | 5/2001 | Pendergrass, Jr. | 451/41 |

FOREIGN PATENT DOCUMENTS

| | | |
|---|---|---|
| EP | 0 806 267 A1 | 11/1997 |
| EP | 0 919 330 A1 | 6/1999 |
| EP | 0 919 336 A2 | 6/1999 |
| WO | WO 95/22436 | 8/1995 |
| WO | WO 98/06541 | 2/1998 |
| WO | WO 98/49723 | 11/1998 |
| WO | WO 98/50201 | 11/1998 |
| WO | WO 99/10129 | 3/1999 |

OTHER PUBLICATIONS

ASTM D5024–94 "Standard Test Methods for measuring the Dynamic Mechanical properties of Plastics in Compression".

* cited by examiner

*Primary Examiner*—George Nguyen
*Assistant Examiner*—Dung Van Nguyen
(74) *Attorney, Agent, or Firm*—Scott R. Pribnow

(57) ABSTRACT

An abrasive article includes a fixed abrasive element, a resilient element, a rigid element disposed between the resilient element and the fixed abrasive element, and a plurality of microstructures disposed between the rigid element and the fixed abrasive element.

75 Claims, 5 Drawing Sheets

ABRASIVE ARTICLE SUITABLE FOR MODIFYING A SEMICONDUCTOR WAFER

BACKGROUND

The invention relates to abrasive articles suitable for modifying a semiconductor wafer.

Chemical mechanical planarization (CMP) processes are used in semiconductor wafer fabrication to polish and planarize a semiconductor wafer. CMP processes involve placing an abrasive between a relatively stiff pad and a semiconductor wafer and moving the pad and the semiconductor wafer in relation to each other to modify the surface of the wafer. The abrasive can be in the form of a fixed abrasive element, e.g., an element that includes abrasive particles bonded to a backing, or a slurry, i.e., a liquid medium that includes abrasive particles. The support pad used in CMP processes that employ a fixed abrasive element is referred to as a subpad and includes a continuous rigid layer disposed on a resilient layer. The fixed abrasive element is often attached to the rigid layer and the resilient layer is often attached to a machine platen.

CMP processes attempt to remove material selectively from relatively higher locations, i.e., features having dimensions on the scale of those features commonly produced by photolithography, to planarize the wafer surface. CMP processes also attempt to remove material uniformly on the scale of the semiconductor wafer so that each die on the wafer is planarized to the same degree in an equivalent period of time. The rate of planarization for each die is preferably uniform over the entire wafer. It is difficult to achieve both of these objectives simultaneously because semiconductor wafers are often warped or curved. Some semiconductor wafers also include numerous step height variations or protrusions, which are produced during the fabrication sequence of an integrated circuit on a wafer. These height variations and the curvature and warp of the semiconductor wafer can interfere with the uniformity of the polishing process such that some regions of the wafer become over polished while other regions remain under polished.

SUMMARY

In one aspect, the invention features an abrasive article that includes a fixed abrasive element, a resilient element, a rigid element disposed between the resilient element and the fixed abrasive element, and a plurality of microstructures disposed between the rigid element and the fixed abrasive element. In one embodiment, the microstructures are bonded to the rigid element. In another embodiment, the microstructures are bonded to the rigid element through an adhesive composition. In other embodiments, the microstructures extend from the rigid element.

In some embodiments, the microstructures include a layer substantially coextensive with the fixed abrasive element. In other embodiments, the plurality of microstructures is in the form of a discontinuous layer.

In one embodiment, the article further includes a microstructure element that includes a first plurality of microstructures having a first dimension and being disposed on a first region of the microstructure element, and a second plurality of microstructures having a second dimension and being disposed on a second region of the microstructure element. In one embodiment, the first region has a first microstructure spacing density, and the second region has a second microstructure spacing density.

In other embodiments, the article further includes a microstructure element that includes a first region that includes the microstructures and having a first microstructure spacing density and a second region that includes the microstructures and having a second microstructure spacing density.

In some embodiments, a cross-section of the microstructures has a shape selected from the group consisting of a polygon, a circle and an ellipse. In other embodiments, the microstructures have a shape selected from the group consisting of pyramidal, cylindrical, conical, frusto-hemispherical, frusto-pyramidal, frusto-conical and other frusta. In another embodiment, the microstructures are arranged in a pattern. In one embodiment, the microstructures are arranged in a pattern that includes offset rows of microstructures. In some embodiments, the microstructures are arranged in a pattern that includes aligned rows of microstructures.

In other embodiments, the microstructures include particles disposed in a binder. In some embodiments, the particles include polytetrafluoroethylene. In other embodiments the microstructures include a thermoplastic polymer. In another embodiment, the microstructures include a thermoset polymer. In some embodiments, the microstructures include metal, e.g., a metal selected from the group consisting of stainless steel, nickel, chromium and combinations thereof. In some embodiments, the microstructures include ceramic. In other embodiments, the microstructures further include metal and the ceramic is disposed on the metal. In still other embodiments, the microstructures include glass. In some embodiments, the microstructures further include metal and the glass is disposed on the metal.

In one embodiment, the microstructures have a height no greater than about 250 $\mu$m. In one embodiment, at least about 120 microstructures/cm$^2$ are disposed between the rigid element and the fixed abrasive element. In some embodiments, the microstructures have a cross-sectional area of no greater than about 10,000 $\mu$m$^2$. In other embodiments, the microstructures have a cross-sectional area of no greater than about 50,000 $\mu$m$^2$. In some embodiments, the microstructure element has no greater than about 20% bearing area.

In another embodiment, the abrasive element includes a first region that includes structures that includes abrasive particles and a second region free of abrasive particles. In some embodiments, the fixed abrasive element includes a textured, fixed abrasive element. In other embodiments, the article further includes a microstructure element that includes the microstructures and a backing and the microstructures are disposed on the backing. In some embodiments, the rigid element includes rigid segments. In one embodiment, the rigid segments extend from a common substrate.

In another aspect, the invention features an abrasive article that includes a fixed abrasive element that includes a backing and a composition disposed on a first major surface of the backing, the composition includes a binder and a plurality of abrasive particles, and a microstructure element bonded to a major surface of the abrasive element opposite the abrasive surface, the microstructure element including a plurality of microstructures. In some embodiments, the article further includes a rigid element and the microstructure element is bonded to the rigid element. In one embodiment, the article further includes a rigid element and the microstructures extend from the rigid element.

In other aspects, the invention features an abrasive article that includes an abrasive element that includes a plurality of structures disposed on a first surface of the abrasive element, the structures being at least essentially free of abrasive particles, and a plurality of microstructures bonded to a second surface of the abrasive element, the second surface being opposite the first surface. In some embodiments, the abrasive article further includes a rigid element and the microstructures are disposed between the rigid element and the abrasive element. In other embodiments, the abrasive article further includes a resilient element and the rigid element is disposed between the resilient element and the abrasive element.

In another aspect, the invention features an apparatus for modifying the surface of a workpiece, the apparatus that includes a fixed abrasive element, a resilient element, a rigid element disposed between the resilient element and the fixed abrasive element and a plurality of microstructures disposed between the rigid element and the fixed abrasive element. In one embodiment, the fixed abrasive element is movable relative to the plurality of microstructures. In some embodiments, the plurality of microstructures and the rigid element are movable relative to the fixed abrasive element. In other embodiments, the apparatus further includes a first web that includes the fixed abrasive element, a second web that includes the plurality of microstructures and a third web that includes the resilient element.

In some embodiments, at least one of the first web, the second web and the third web are movable relative to another of the first web, the second web and the third web. In other embodiments, the second web further includes the rigid element. In other embodiments, the microstructures extend from the rigid element. In some embodiments, the rigid element includes rigid segments. In another embodiment, the rigid segments extend from a common rigid substrate.

In other aspects, the invention features a method of modifying the surface of a semiconductor wafer that includes contacting an above-described abrasive article a substrate suitable for the manufacture of semiconductor devices, and moving the substrate and the abrasive article relative to each other. In some embodiments, the method further includes contacting a first region of the abrasive article with the substrate, the first region that includes a first plurality of microstructures having a first cross-sectional area, moving the substrate and the abrasive article relative to each other, contacting a second region of the abrasive article with the substrate, the second region that includes a second plurality of the microstructures having a second cross-sectional area, and moving the substrate and the abrasive article relative to each other. In another embodiment, the abrasive article further includes a web that includes the plurality of microstructures and the method further includes indexing the web from a first position to a second position.

The "apparent contact area" of a microstructure refers to the surface area of a microstructure that appears to be available for contact with an abrasive element when the two entities are in contact with each other under some applied load.

The phrase "% bearing area" refers to the area on an article that constitutes the apparent contact area relative to the total planar area of the article in a given region of the article, e.g., a region of the article having a planar area similar or equal to the planar area of a semiconductor wafer.

Microstructures disposed between a relatively more rigid element and a fixed abrasive element provide points of rigid support to the fixed abrasive element. The points of rigid support facilitate substrate planarization and can reduce the amount of overpolishing that tends to occur at the edges of individual dies on the surface of the semiconductor wafer being modified with the article. An abrasive article constructed with microstructures can also provide good polishing at the submicron level.

The presence of the microstructures in the abrasive article can also alter the degree of polishing imparted by the fixed abrasive article and enhance the degree of polishing that occurs during a CMP process.

Other features of the invention will be apparent from the following description of preferred embodiments thereof, and from the claims.

DRAWINGS

Figure 13A:
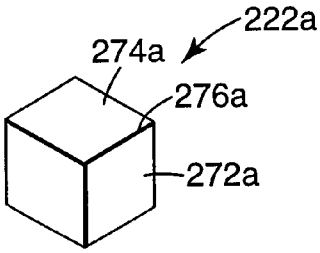
Figure 13B:
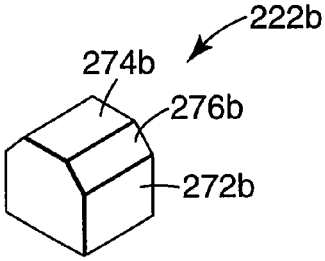
Figure 13C:
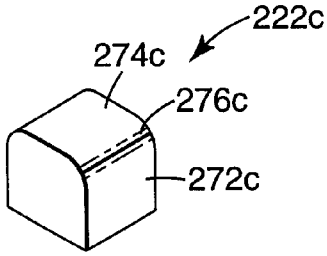
Figure 14:
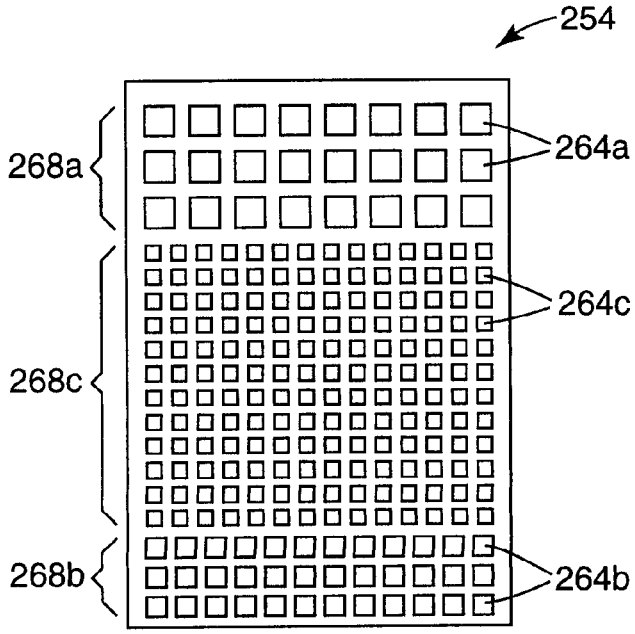
Figure 15:
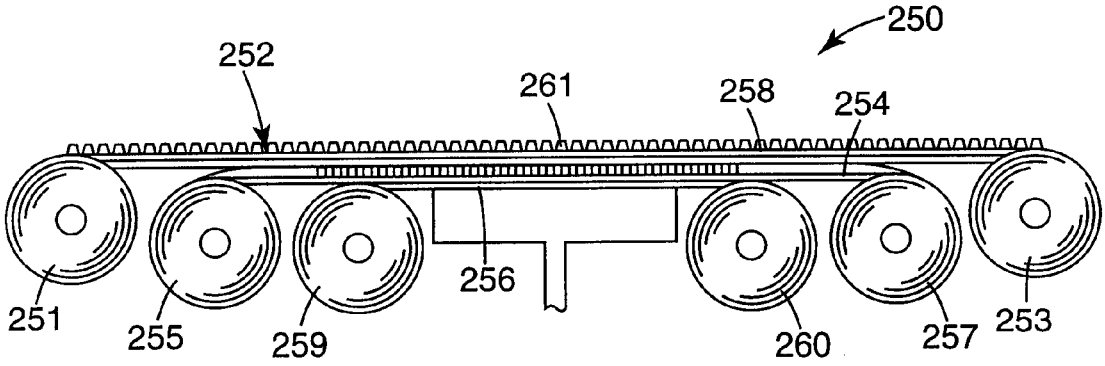

FIGS. 13*a*–13*c* are perspective side views of individual rigid segments;

FIG. 14 is a top view of a segmented rigid element;

FIG. 15 is a side view of an apparatus for modifying a substrate that includes an abrasive article according to one embodiment of the invention.

DETAILED DESCRIPTION OF THE PREFERRED EMBODIMENTS

Figure 1:
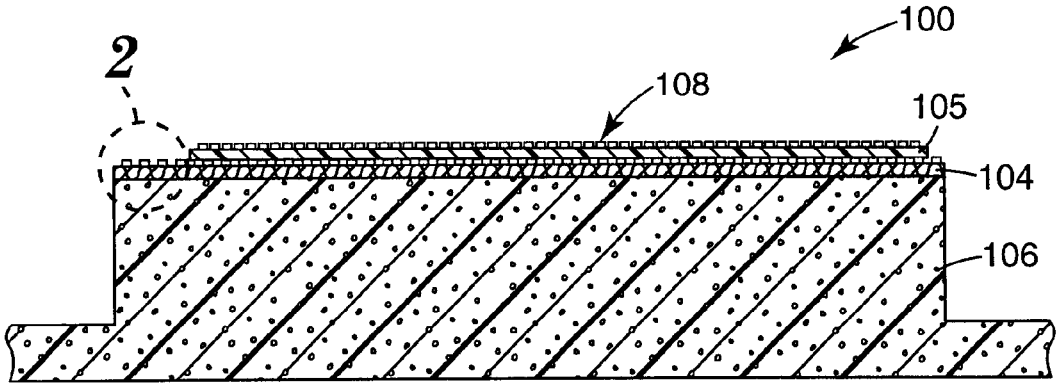
FIG. 1 is a schematic cross sectional view of an abrasive article of the invention.
Figure 2:
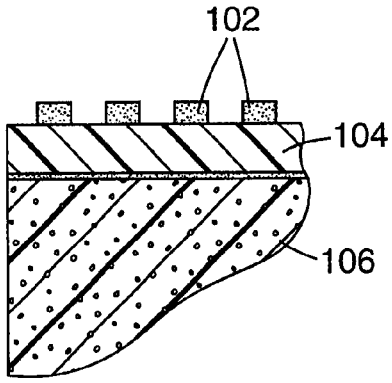
FIG. 2 is an enlarged view of the area indicated by number 2 in FIG. 1.
Figure 3:
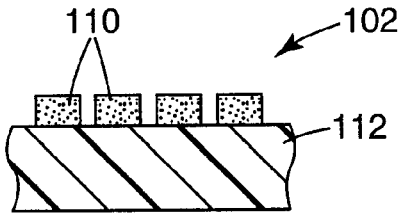
FIG. 3 is schematic cross sectional view of a microstructure element.

Referring to the Figures, wherein like numerals are used to designate like features throughout and first to FIGS. 1–3, there is shown an abrasive article 100 that includes a microstructure element 102 disposed between a relatively more rigid element 104, which is disposed on a relatively more resilient element 106, and a fixed abrasive element 108.

The microstructure element 102 includes microstructures 110, optionally attached to a backing 112, and can be constructed in a variety of forms including, e.g., discs and webs. The number of microstructures per unit area of the microstructure element and the dimensions, shape and arrangement of the microstructures can be selected to achieve a desired degree of polishing or planarization.

The number of microstructures and the area of the top surface, i.e., the surface of the microstructure available for contact with the abrasive element, of each microstructure preferably combine to provide a microstructure element having from about 5% bearing area to about 80% bearing area, more preferably at least about 10% bearing area.

The microstructure element can include microstructures that overlap each other, are spaced a distance apart from each other, and combinations thereof. The spacing of the microstructures on the microstructure element, i.e., the microstructure spacing density, can range from about 1 microstructure/linear cm to about 100 microstructure/linear cm, preferably between about 5 microstructure/linear cm to about 80 microstructures/linear cm, more preferably between about 10 microstructure/linear cm to about 60 microstructure/linear cm, most preferably between about 15 microstructure/linear cm to about 50 microstructure/linear cm. The microstructures can also be arranged such that the concentration of microstructures is greater in one location of the abrasive article than in another area of the abrasive article (e.g., the concentration of microstructures can be greatest in the center of the abrasive article).

In one embodiment, the microstructures have a fixed base and terminate in a free top end that is available for contact with the fixed abrasive element, e.g., the backing (where present) of the fixed abrasive element. The top end of the microstructure preferably has a surface area from about 10,000 $\mu m^2$ to about 1,000,000 $\mu m^2$. The microstructures can also be dimensioned such that the area of the top surface of a microstructure corresponds to the size, i.e., area of the top surface, of a feature, e.g., a die, on a semiconductor wafer. Preferably the cross-sectional area at the top surface of the microstructure is slightly larger than, e.g., 10 times, the size of the feature on the semiconductor wafer. The footprint of a microstructure preferably is sufficient to encompass the footprint of from about 1 to 100 abrasive composites of the type described in U.S. Pat. No. 5,958,794 (Bruxvoort et al.).

The microstructures can have the same height or varying heights; preferably the tops of the microstructures lie in substantially the same plane. For circular pad-type abrasive article applications the height of the microstructures may vary across a radius. The height of the microstructures preferably is no greater than 200 micrometers, more preferably from about 25 to 200 micrometers.

Useful microstructures include precisely shaped and irregularly shaped microstructures. Suitable microstructure shapes include, e.g., cubic, cylindrical, prismatic, pyramidal, frusto-pyramidal, conical, frusto-conical, other frusta, raised cross regions, X-shaped regions, post-like with a top surface that is substantially flat, hemispherical as described in, e.g., WO 95/224,436, and combinations thereof. The microstructure, when taken in cross-section in a plane of the microstructure that is parallel to the working surface of the abrasive article, can also define a variety of shapes including, e.g., circle, ellipse and polygon including, e.g., triangle, square, rectangle, hexagon, heptagon and octagon.

The microstructures can include sides that are perpendicular relative to the backing of the abrasive element, sides that taper with diminishing width toward the backing of the abrasive element and away from the more rigid substrate, sides that are undercut, and combinations thereof. For microstructures prepared from a cavity production tool, examples of which are described in U.S. Pat. No. 5,958,794 (Bruxvoort et al.), if the sides of the microstructure are tapered, the microstructure or sheet of microstructures is easier to remove from the tool. The angle forming the taper can range from about 1 to 75 degrees, preferably from about 2 to 50 degrees, more preferably from about 3 to 35 degrees, most preferably from about 5 to 15 degrees.

The microstructures can be arranged on the microstructure element in a variety of configurations including, e.g., repeating patterns, randomly, rows, spiral, helix, corkscrew, or lattice fashion. The microstructures are preferably provided in a predetermined pattern. The predetermined pattern of microstructures can correspond to the pattern of cavities on a production tool used to form the microstructures, which enables the pattern to be reproduced in each microstructure element made from a particular production tool. One example of a predetermined pattern includes microstructures in a regular array, e.g., aligned rows and columns or alternating offset rows and columns. The microstructures can also be arranged such that one row of microstructures is directly aligned in front of a second row of microstructures. Alternatively, one row of microstructures can be offset from the second row of microstructures.

Figure 4:
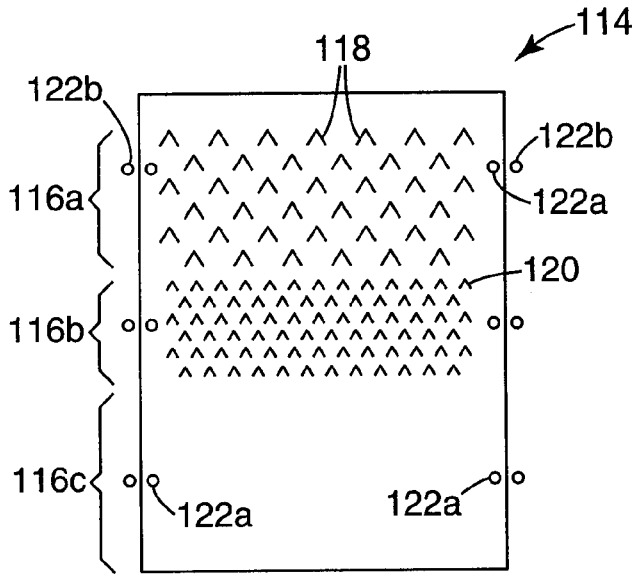
FIG. 4 is a top plan view of a microstructure element according to a second embodiment.

In other embodiments, the microstructure element includes a number of regions including, e.g., regions having microstructures of different dimensions, shapes, number per unit area, and combinations thereof. Examples of useful microstructure elements that include regions include microstructure elements having a region that includes microstructures of relatively larger dimensions, a region that includes microstructures of relatively smaller dimensions, or a region that is devoid of microstructures, i.e., a smooth surface, and combinations thereof. FIG. 4 illustrates a microstructure element 114 in the form of a web that includes a region 116*a* having relatively larger microstructures 118 spaced a distance apart from each other, a region 116*b* having relatively smaller microstructures 120 spaced a smaller distance apart from one another, and a region 116*c* that is devoid of microstructures. In other embodiments, one region has a greater density of microstructures, i.e., the microstructures in a given area are located closer to each, relative to the density of microstructures in a second region. The microstructure element 114 illustrated in FIG. 4 also includes locators 122*a*. Locators 122*a* can be used in conjunction with other indicia including, e.g., locators 122*b*, to enable an apparatus to identify the location of a semiconductor wafer relative to a desired location on the microstructure element.

The presence of regions on the microstructure element produces a topography that varies across the surface of the microstructure element. The difference in topography can be used to alter the polishing properties of an abrasive article constructed therewith. In a polishing process, the mechanism that controls the movement of the substrate to be modified relative to the abrasive article can be preprogrammed such that the substrate contacts the various regions of the abrasive article according to a predetermined sequence to achieve a desired surface modification. Alternatively, the surface modifying apparatus that incorporates the microstructure element can be programmed to index the abrasive article or a component of the abrasive article, e.g., the microstructure element, so as to alter the nature of the abrasive article that contacts the semiconductor wafer.

The microstructures can include polymers including, e.g., thermoset and thermoplastic polymers, metals, and combinations thereof. Examples of useful thermoset polymers include vinyl acrylates, acrylated epoxies, acrylated urethanes, acrylated polyesters, acrylated acrylics, acrylated polyethers, vinyl ethers, acrylated oils and acrylated silicones, alkyd resins such as urethane alky resins, polyester resins, reactive urethane resins, phenolic resins such as resole and novolac resins, phenolic/latex resins, epoxy resins including, e.g., bisphenol epoxy resins, isocyanates, isocyanurates, polysilioxane resins including alkylalkoxysilane resins, reactive vinyl resins and mixtures thereof.

Examples of useful thermoplastic polymers include polycarbonates, polyvinylalcohol, polyacrylonitrile, acrylonitrile-butadiene-styrene, styrene-acrylonitrile, cellulose, chlorinated polyether, ethylenevinylacetate, polyamides including, e.g., polycaprolactam, polyhexamethylene adipamide, polyhexamethylene sebacamide, polyundecanoamide and polylauroamide; polycarbonate, polyolefins including, e.g., polyethylene, polypropylene, polybutene and poly-4-methyl pentene; polyethyleneterephthalate; polyphenylene oxide; polystyrene; polyurethane; polyisocyanurates; vinyl polymers including, e.g., polyvinyl chloride, polyvinyl acetate, polyvinyl alcohol, polyvinyl butyral, polyvinyl pyrrolidone and polyvinylidene chloride.

Examples of suitable metals include stainless steel, nickel and chromium.

The microstructures can also include particles. The particles can be included in the microstructures to enhance the wear resistance, i.e., useful life, of the microstructure element. The particles can be selected to alter, preferably decrease, the coefficient of friction, e.g., impart a slippery property, between the microstructure element and the abrasive article, which can facilitate the movement of a web containing the microstructures relative to a second web, e.g., the fixed abrasive web, relative to a microstructure element that is free of the particles. Polytetrafluoroethylene is one example of a particulate material that can be used to decrease the coefficient of friction between the microstructures and a web in contact with the microstructures.

The microstructures can extend from a common base, be disposed on a separate backing, and combinations thereof. In one embodiment, the microstructures extend from the rigid element, i.e., they form a textured surface on the rigid element as a result of a texturizing process, e.g., embossing. Useful backings for the microstructure element include, e.g., films, wovens and nonwovens. Useful backing materials include, e.g., thermoset and thermoplastic polymers, cellulose, metal, ceramic, glass, and combinations thereof.

Microstructures and microstructure elements can be formed according to a variety of methods including, e.g., molding, extruding, embossing and combinations thereof. Useful methods of forming microstructure elements are described, e.g., in U.S. Pat. Nos. 5,897,930, 5,183,597, 4,588,258, 4,576,850 and 4,374,077, and incorporated herein. Other useful methods for making microstructure elements include the general methods of making three-dimension abrasive articles disclosed in U.S. Pat. No. 5,958,794.

Figure 5:
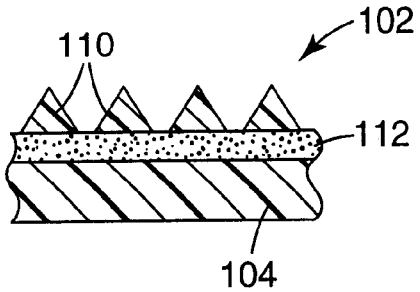
FIG. 5 is a cross sectional view of one embodiment of a microstructure element on a rigid substrate.
Figure 6:
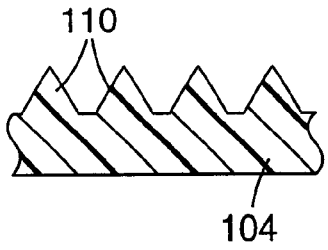
FIG. 6 is a cross sectional view of another embodiment of a microstructure element on a rigid substrate.

The rigid element of the abrasive article can be a continuous or discontinuous, e.g., divided into segments, layer and can be in a variety of forms including, e.g., a round disk and a continuous web, e.g., a belt. The microstructure element can be attached to the rigid element using a variety of mechanisms including, e.g., an adhesive composition, sonic welding, heat welding, mechanical fasteners, and combinations thereof. The microstructure element can also be an extension of the rigid element material as in the case, e.g., when the microstructures are formed, e.g., molded or embossed, simultaneously with the rigid element or grown directly on the rigid element. FIG. 5 illustrates a microstructure element 102 that includes microstructures 110 disposed on a backing 112 and bonded to a rigid element 104. FIG. 6, illustrates microstructures 110 extending directly from the rigid element 104.

The material of the rigid element is selected in combination with the material of the resilient element to provide an abrasive construction that exhibits uniform material removal across the surface of the substrate to be modified, i.e., good uniformity and planarity on patterned wafers, which includes flatness and dishing, i.e., the measure of the planarization ratio.

Suitable rigid substrate materials include, e.g., organic polymers, inorganic polymers, ceramics, metals, composites of organic polymers, and combinations thereof. Suitable organic polymers can be thermoplastic or thermoset. Suitable thermoplastic materials include, polycarbonates, polyesters, polyurethanes, polystyrenes, polyolefins, polyperfluoroolefins, polyvinyl chlorides, and copolymers thereof. Suitable thermosetting polymers include, e.g., epoxies, polyimides, polyesters, and copolymers thereof (i.e., polymers containing at least two different monomers including, e.g., terpolymers and tetrapolymers).

The polymer of the rigid substrate may be reinforced. The reinforcement can be in the form of fibers or particulate material. Suitable materials for use as reinforcement include, e.g., organic or inorganic fibers (e.g., continuous or staple), silicates, e.g., mica or talc, silica-based materials, e.g., sand and quartz, metal particulates, glass, metallic oxides and calcium carbonate, or a combination thereof.

Metal sheets can also be used as the rigid element. Preferably the metal sheet is very thin, e.g., from about 0.075 to about 0.25 mm. Suitable metals include, e.g., aluminum, stainless steel, copper, nickel, and chromium.

Particularly useful rigid materials include poly(ethylene terephthalate), polycarbonate, glass fiber reinforced epoxy boards, aluminum, stainless steel and IC 1000 (available from Rodel, Inc., Newark, Del.).

The resilient element can be a continuous layer or a discontinuous layer, e.g., divided into segments. The resilient element can include a layer of material or a number of layers of the same or different material, provided that the mechanical behavior of the resilient element is acceptable for the desired application. The resilient element is preferably capable of undergoing compression during a surface modification process. The resiliency, i.e., the stiffness in compression and elastic rebound, of the resilient element is related to the modulus of the material of the resilient element in the thickness direction and is also affected by the thickness of the resilient element.

The choice of material for the resilient element, as well as the thickness of the resilient element, will vary depending on the variables in the process including, e.g., the composition of the workpiece surface and fixed abrasive element, the shape and initial flatness of the workpiece surface, the type of apparatus used for modifying the surface (e.g., planarizing the surface), and the pressures used it the modifying process.

Preferably the resilient material including, e.g., the overall resilient element, has a Young's modulus of less than about 100 MPa, more preferably less than about 50 MPa. Dynamic compressive testing of resilient materials can be used to measure the Young's Modulus (often referred to as the storage or elastic modulus) in the thickness direction of the resilient material. ASTM D5024-94 (Standard Test methods for measuring the Dynamic Mechanical properties of Plastics in Compression) is a useful method for measuring the young's Modulus of resilient material, whether the resilient element is one layer or a laminated element that includes multiple layers of materials. The Young's Modulus of the resilient element is determined according to ASTM D5024-

94 of the material at 20° C. and 0.1 Hz with a preload equal to the nominal CMP process pressure.

Suitable resilient materials can also be selected by additionally evaluating their stress relaxation. Stress relaxation is evaluated by deforming a material and holding it in the deformed state while the force or stress needed to maintain deformation is measured. Suitable resilient materials preferably retain at least about 60%, more preferably at least about 70% of the initially applied stress, after 120 seconds. This is referred to herein as the "remaining stress" and is determined by first compressing a sample of material to no less than 0.5 mm thick at a rate of 25.4 mm/minute until an initial stress of 83 kPa is achieve at room temperature (20° C.–25° C.) and measuring the remaining stress after 2 minutes.

The resilient element can include a wide variety of resilient materials. Examples of useful resilient materials include organic polymers including, e.g., a thermoplastic, thermoset, and elastomeric. Suitable organic polymers include those organic polymers that are foamed or blown to produce porous organic structures, i.e., foams. Such foams may be prepared from natural or synthetic rubber or other thermoplastic elastomers including, e.g., polyolefins, polyesters, polyamides, polyurethanes, and copolymers thereof. Suitable synthetic thermoplastic elastomers include, e.g., chloroprene rubbers, ethylene/propylene rubbers, butyl rubbers, polybutadienes, polyisoprenes, EPDM polymer, polyvinyl chlorides, polychloroprenes, styrene-butadiene copolymers, and styrene-isoprene copolymers, and mixtures thereof. One example of a useful resilient material is a copolymer of polyethylene and ethylvinyl acetate in the form of a foam.

Other useful resilient materials include polyurethane impregnated felt-based materials, nonwoven or woven fiber mats that include, e.g., polyolefin, polyester or polyamide fibers, and resin impregnated woven and nonwoven materials.

Examples of useful commercially available resilient materials include poly(ethylene-co-vinyl acetate) foams available under the trade designations 3M SCOTCH brand CUSHIONMOUNT Plate Mounting Tape 949 double-coated high density elastomeric foam tape available from 3M Company (St. Paul, Minn.), EO EVA foam available from Voltek (Lawrence, Mass.), EMR 1025 polyethylene foam available from Sentinel Products (Hyannis, N.J.), HD200 polyurethane foam available from Illburck, Inc. (Minneapolis, Minn.), MC8000 and MC8000EVA foams available from Sentinel Products and SUBA IV Impregnated Nonwoven available from Rodel, Inc. (Newark, Del.).

Commercially available pads having rigid and resilient elements that are used in slurry polishing operations are also suitable. An example of such a pad is available under the trade designation IC1000-SUBA IV (Rodel, Inc.).

The abrasive element is capable of abrading the surface of a wafer in the absence of abrasive slurry during a chemical mechanical planarization process. The abrasive element can be a fixed abrasive element, i.e., an abrasive article that includes a plurality of abrasive particles in fixed position in a binder. A fixed abrasive element is substantially free of unattached abrasive particles except as may be generated during the planarization process. The particles and binder of the fixed abrasive element may optionally be bonded to a support, e.g., a backing.

The abrasive element can also be textured such that it includes raised portions and recessed portions in which at least the raised portions include abrasive particles in a binder.

Preferably the abrasive element is a three-dimensional abrasive article. Three-dimensional abrasive articles include numerous abrasive particles extending throughout at least a portion of the thickness of the article such that removing some of the particles during planarization exposes additional abrasive particles capable of performing the planarization function. Examples of useful three-dimensional, textured, fixed abrasive articles are disclosed in U.S. Pat. No. 5,958,794 (Bruxvoort et al.) and PCT application WO 98/49723 (Kaisaki), and incorporated herein.

The abrasive element can include structures separated by recessed portions. The structures can include abrasive particles or be free of abrasive particles and the abrasive element can include structures that are free of abrasive particles, structures that include abrasive particles and combinations thereof. The structures of the abrasive element can be arranged in a pattern, randomly and combinations thereof.

The abrasive element can be in the form of a layer extending across other components of the abrasive article including, e.g., the microstructure element, rigid segments, and combinations thereof. The abrasive element can also be coextensive with individual rigid segments.

Figure 7:
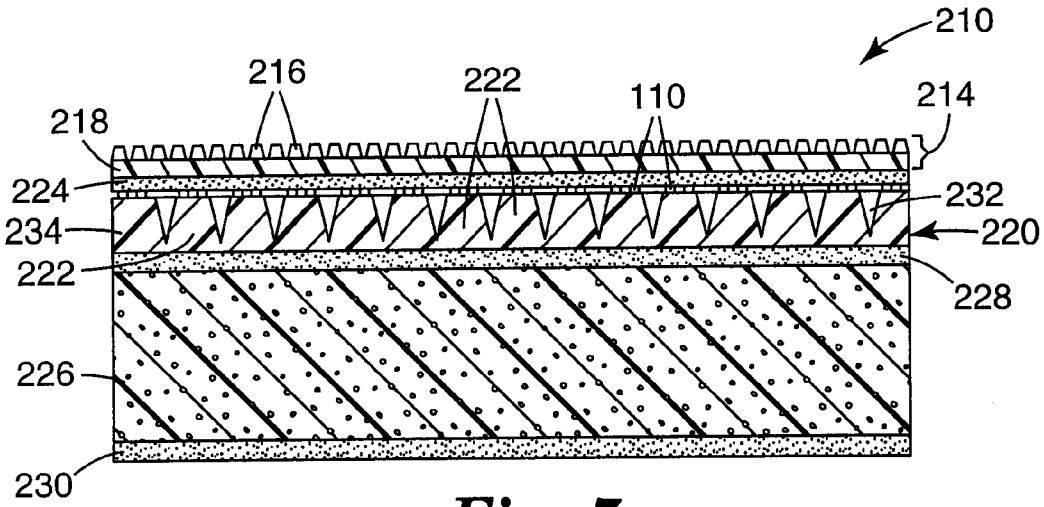
FIG. 7 is a schematic cross sectional view of an abrasive article according to another embodiment of the invention.
Figure 8:
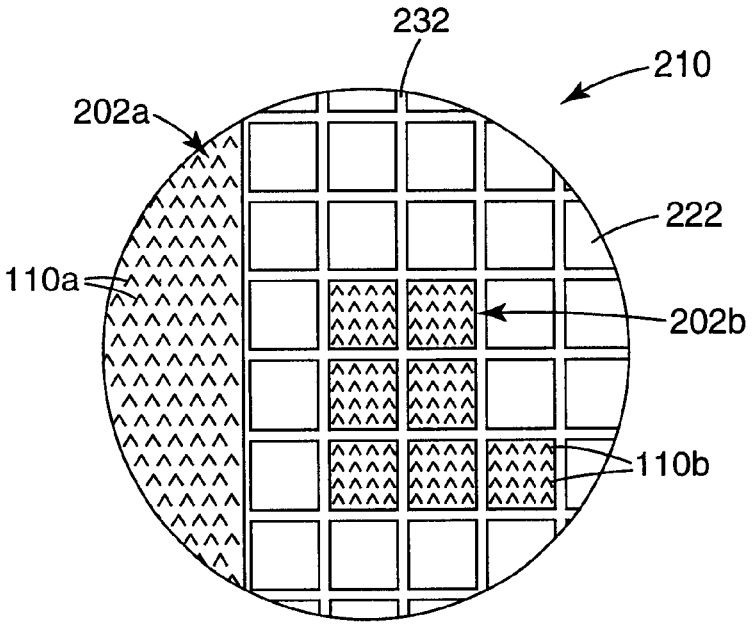
FIG. 8 is a top plan view of the layer of rigid segments and microstructure element of the abrasive article of FIG. 7.

FIGS. 7 and 8 illustrate another embodiment of the abrasive article 210. The abrasive article 210 includes microstructures 110 disposed between a segmented relatively more rigid element 220 and a fixed abrasive element 214, which includes fixed abrasive composites 216 disposed on a backing 218. The fixed abrasive element 214 is bonded to the microstructures 110 through an adhesive composition 224. The relatively more rigid element 220 is disposed between the microstructures 110 and a relatively more resilient element 226. The abrasive article 210 further includes a layer of adhesive composition 230 disposed on the bottom surface of the resilient element 226 for use in attaching the abrasive article to a machine platen. Microstructure elements 202*a*, 202*b* are disposed on the segmented rigid element 220, which includes a number of segments 222 spaced apart by grooves 232. A microstructure element 202*a* in the form of a continuous coating of microstructures 110*a* extends over a number of rigid segments and another microstructure element 202*b* includes microstructures 110*b* extending from individual rigid segments 222*b*.

The dimensions of the rigid segments are selected to optimize localized planarity and global uniformity and to achieve a predetermined edge exclusion zone on a semiconductor wafer being modified by the abrasive article constructed with the rigid element. The size of the rigid segment can be selected based upon the surface characteristics, e.g., die layout, e.g., repeat pattern of the die, and die size relative to the desired edge exclusion zone, of the semiconductor wafer being modified therewith. Preferably the footprint of the rigid segment is no greater than the desired edge exclusion such that the pressure exerted by a rigid segment that does not extend beyond the edge of the semiconductor wafer is not affected by the proximity of the rigid segment to the edge of the semiconductor wafer. The rigid segments are also preferably dimensioned to provide a neighborhood, i.e., footprint, of localized rigidity that approximates or is slightly larger than the footprint of an individual die or repeating lithographic pattern on the semiconductor wafer to be modified. Preferably the rigid segments are from about 0.5 to about 4 times the size of the smallest dimension of the die being polished. Useful rigid segments have a cross-sectional area taken in a plane of the segment that is parallel to the working surface of the abrasive article that is no greater than about 400 $mm^2$.

The rigid segments 222 are separated from one another by grooves 232 extending into the depth of a rigid element 234 and across the surface of the rigid element 234. The grooves 232 render the rigid element 234 relatively more flexible than the rigid element without the grooves such that the rigid element 234 as a whole is capable of conforming to the surface of a semiconductor wafer 238 while the individual segments 32 remain rigid.

The depth to which the grooves 232 extend into the rigid element 234 can vary. The rigid element 234 can include, e.g., grooves 232 that extend into the rigid element 234, through the rigid element 234, through the rigid element 234 and into the underlying relatively more resilient element 226, through the rigid element 234 and through the underlying relatively more resilient element 226, or a combination thereof. As a groove 232 extends farther into the depth of the subpad, the abrasive article construction becomes more flexible. Preferably the grooves extend through the rigid element 234 to provide rigid segments 222 that sit on the resilient element 226 and move substantially independently of the other rigid segments so as to allow the rigid layer to conform to the surface of the semiconductor wafer while maintaining localized planarization. More preferably, the movement of one rigid segment is not imparted or transferred to any of its neighboring segments.

Figure 9:
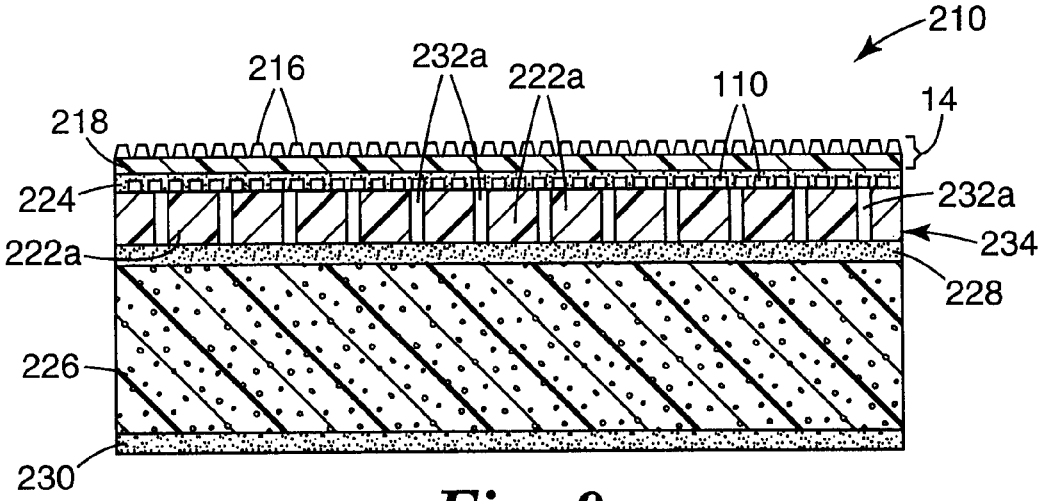
FIG. 9 is a schematic cross sectional view of an abrasive article according to a third embodiment of the invention.
Figure 10:
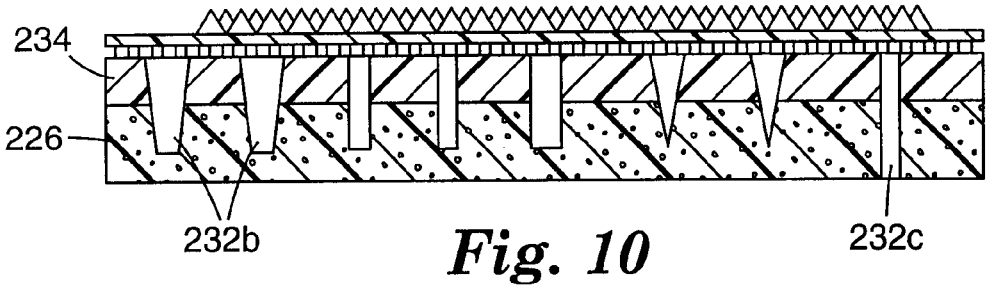
FIG. 10 is a schematic cross sectional view of an abrasive article according to a fourth embodiment of the invention.

FIG. 7 illustrates an abrasive article 210 that includes grooves 232 extending into the rigid element 234. FIG. 9 illustrates grooves 232*a* passing through the rigid element 234 such that rigid segments 222*a* are independently suspended on the resilient element 226. FIG. 10 illustrates grooves 232*b* passing through the rigid element 234 and extending into the resilient element 226 and grooves 232*c* passing through the rigid element 234 and through the resilient element 226.

Figure 11:
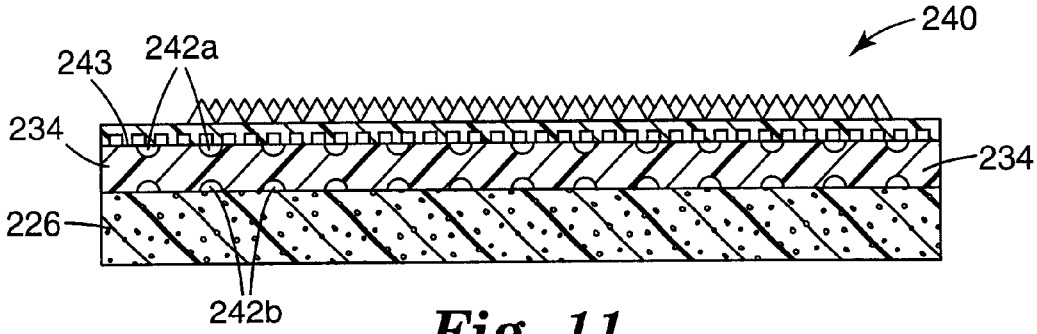
FIG. 11 is a schematic cross sectional view of an abrasive article according to a fourth embodiment of the invention.

FIG. 11 illustrates an abrasive article 240 that includes grooves 242*a* extending into the rigid element 234 from the top surface 243 of the rigid element 234 and grooves 242*b* extending into the rigid element 234 from the bottom surface 244 of the rigid element 234.

The width of the grooves, i.e., the spacing between segments, is selected based on the desired subpad flexibility and conformity. The width of the groove can be increased such that the segments are completely separated or substantially completely separated from each other. In general, during CMP processes, the nominal pressure at the wafer surface is controlled by imposing pressure on the back side of the wafer. For wider grooves, the fraction of the total plan area occupied by the rigid segments is reduced. Since pressure is transmitted through the rigid segments, the total force exerted on the back side of the wafer is transmitted through a smaller total area relative to an unsegmented rigid element and the nominal pressure at the tops of the rigid segments, where material removal processes occur, is increased. In such circumstances, the nominal pressure exerted on the segments and transferred to the semiconductor wafer can be controlled by changing the percentage of segments, e.g., if 50% of the planar area of the rigid element includes segments, the average pressure at the process surface increases by a factor of 2 over the nominal applied pressure. The effect of groove width on the process pressure is another factor to be considered in choosing groove width.

The shape of the groove is defined by at least one side wall, e.g., a continuous arcuate side wall, and can be defined by two or more side walls including, e.g., two substantially parallel side walls, two diverging or converging side walls, and two side walls separated by the bottom wall of the groove.

Figure 12:
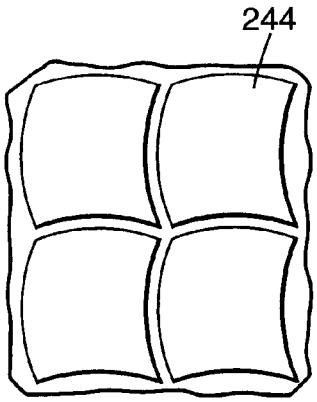
FIG. 12 is a top view of interdigitated rigid segments according to one embodiment of the rigid element.

The grooves can be arranged to define rigid segments having a variety of shapes including, e.g., circular, elliptical, polygonal, e.g., triangles, rectangles, hexagons, and octagons. The rigid segments can have a variety of forms including, e.g., parallelepiped, cylindrical, conical, pyramidal, frusto-pyramidal, frusto-conical and other frusta. FIG. 8 illustrates an array of grooves positioned at right angles to each other to define generally square rigid segments 222. The rigid segments 244 can also be shaped to interdigitate with one another as illustrated, e.g., in FIG. 12.

FIG. 13*a* illustrates a rigid segment 222*a* in which the union 276*a* of a side wall 272*a* and the top wall 274*a*, i.e., the surface of the rigid segment that is closest to the abrasive element, of a rigid segment 222*a* form a 90° angle. The union 276 of the side walls 272 and the top wall 274 can also be other than a 90° angle including, e.g., a slanted or curved union. FIG. 13*b* illustrates a rigid segment 222*b* in which the union 276*b* between the side wall 272*b* and the top wall 274*b* is tapered, i.e., beveled. FIG. 13*c* illustrates a rigid segment in which the union 276*c* between the side walls 272*c* and the top wall 274*c* is rounded. Tapering or rounding one or more of the corners of the rigid segment at the top of the rigid segment provides for a relatively smoother transition for the semiconductor wafer moving across the surface of an abrasive article constructed therewith.

Referring to FIG. 14, the rigid element 254 can also include a number of rigid segments 264*a*, 264*b* and 264*c* having different dimensions (e.g., cross-sectional area), spacing or shapes, and located in different regions 268*a*, 268*b* and 268*c* on the rigid element.

Useful abrasive article constructions include, e.g., disc, web and multiple web constructions. The components of the abrasive article can be maintained in fixed relation to each other by an attachment mechanism. Examples of useful means for maintaining the various components of the abrasive article in fixed relation to each another include, e.g., adhesive compositions, mechanical fastening devices, tie layers, and combinations thereof. The components can also be bonded together through processes including, e.g., thermal bonding, ultrasonic welding, microwave-activated bonding, coextrusion of at least two components of the abrasive article, and combinations thereof.

Useful adhesives include, e.g., pressure sensitive adhesives, hot melt adhesives and glue. Suitable pressure sensitive adhesives include a wide variety of pressure sensitive adhesives including, e.g., natural rubber-based adhesives, (meth)acrylate polymers and copolymers, AB or ABA block copolymers of thermoplastic rubbers, e.g., styrene/butadiene or styrene/isoprene block copolymers available under the trade designation KRATON (Shell Chemical Co., Houston, Tex.) or polyolefins. Suitable hot melt adhesives include, e.g., polyester, ethylene vinyl acetate (EVA), polyamides, epoxies, and combinations thereof. The adhesive preferably has sufficient cohesive strength and peel resistance to maintain the components of the abrasive article in fixed relation to each other during use, and is resistant to chemical degradation under conditions of use.

The abrasive article can also include a variety of mechanisms for attachment to a machine platen, e.g., a machine platen used in chemical mechanical planarization, including, e.g., adhesive or mechanical means including, e.g., placement pins, retaining ring, tension, vacuum or a combination thereof.

The abrasive article can be adapted for use in many types of semiconductor wafer planarizing machines including those suitable for use with polishing pads. An example of a suitable commercially available machine is a Chemical Mechanical Planarization (CMP) machine available from IPEC/WESTECH of Phoenix, Ariz.

At least one component of the abrasive article including, e.g., the microstructure element, the resilient element, the abrasive element, the rigid element or a combination thereof, can also be moveable relative to another component of the abrasive article. FIG. 15 illustrates an apparatus 250 for modifying a substrate that includes a number of webs 252, 254, 256 each web extending between unwind rollers 251, 255 and 259, respectively, and takeup rollers 253, 257 and 260, respectively. Web 252 includes an abrasive element 258 of fixed abrasive composites bonded to a backing. Web 254 includes a number of microstructures 261 and web 256 includes a resilient element. The webs 252, 254, 256 can move independently of one another, e.g., the abrasive web 258 is capable of moving independently of the microstructure web 254 and the resilient web 256. Webs 252, 254, 256 can move at the same speed or different speeds and at least one web can remain stationary while another web moves. Alternatively, at least two of the webs 252, 254, 256 can be maintained in fixed relationship to each other, e.g., bonded together, and capable of moving as a single unit.

The webs 252, 254, 256 can be moved independently of or simultaneously with one another to provide an abrasive article that has one or more regions exhibiting predetermined properties. The apparatus 250 may include, e.g., the microstructure element illustrated in FIG. 4. In addition or alternatively, the apparatus 250 may include an abrasive web 258 that includes regions in which the textured, fixed abrasive composites have a more aggressive abrading property, and regions in which the textured, fixed abrasive composites have a less aggressive abrading property, which may result from, e.g., the abrasive web fabrication process or use in a previous polishing operation. Each of these webs 252, 254 can be moved independently of each other to achieve an abrasive article having desired surface modifying properties. The mechanism that controls the movement of the semiconductor wafer relative to the abrasive article can be preprogrammed such that the wafer contacts the various regions of the abrasive article according to a predetermined surface modifying sequence to achieve a desired surface modification.

The abrasive article and apparatus that contain the microstructure element can be used in a variety of semiconductor wafer surface modifying processes including those methods described in, e.g., U.S. Pat. Nos. 5,958,794 (Bruxvoort et al.) and 6,007,407 and incorporated herein.

Other embodiments are within the claims. For example, the abrasive article has been described as being suitable for modifying the surface of a substrate suitable for the manufacture of semiconductor devices, however, the abrasive article can also be constructed to be suitable for use in modifying a variety of substrates using chemical-mechanical planarizing processes including, e.g., copper wafers.

In some embodiments, the microstructure element is a perforated sheet that has a thickness. The continuous portion of the sheet constitutes the microstructures and defines holes having shapes including, e.g., circle, ellipse and polygon including, e.g., triangle, square, diamond, rectangle, hexagon, heptagon and octagon and combinations thereof including, e.g., a sheet having holes of different shapes. The thickness of the sheet defines the height of the microstructures.

What is claimed is:

1. An abrasive article comprising:

a) a fixed abrasive element;

b) a resilient element;

c) a rigid element disposed between said resilient element and said fixed abrasive element; and d) a plurality of microstructures disposed between said rigid element and said fixed abrasive element.

2. The article of claim 1, wherein said microstructures are bonded to said rigid element.

3. The article of claim 1, wherein said microstructures are bonded to said rigid element through an adhesive composition.

4. The article of claim 1, wherein said microstructures extend from said rigid element.

5. The article of claim 1, wherein said microstructures comprise a layer substantially coextensive with said fixed abrasive element.

6. The article of claim 1, wherein said plurality of microstructures is in the form of a discontinuous layer.

7. The article of claim 1, further comprising a microstructure element comprising a first plurality of microstructures having a first dimension and being disposed on a first region of said microstructure element, and a second plurality of microstructures having a second dimension and being disposed on a second region of said microstructure element.

8. The article of claim 1, further comprising a microstructure element comprising a first region comprising said microstructures and having a first microstructure spacing density and a second region comprising said microstructures and having a second microstructure spacing density.

9. The article of claim 7, said first region has a first microstructure spacing density, and said second region has a second microstructure spacing density.

10. The article of claim 1, wherein a cross-section of said microstructures has a shape selected from the group consisting of a polygon, a circle and an ellipse.

11. The article of claim 1, wherein said microstructures have a shape selected from the group consisting of pyramidal, cylindrical, conical, frusto-hemispherical, frusto-pyramidal, frusto-conical and other frusta.

12. The article of claim 1, wherein said microstructures are arranged in a pattern.

13. The article of claim 1, wherein said microstructures are arranged in a pattern comprising offset rows of microstructures.

14. The article of claim 1, wherein said microstructures are arranged in a pattern comprising aligned rows of microstructures.

15. The article of claim 1, wherein said microstructures comprise particles disposed in a binder.

16. The article of claim 15, wherein said particles comprise polytetrafluoroethylene.

17. The article of claim 15, wherein said microstructures comprise a thermoplastic polymer.

18. The article of claim 15, wherein said microstructures comprise a thermoset polymer.

19. The article of claim 15, wherein said microstructures comprise metal.

20. The article of claim 15, wherein said microstructures comprise a metal selected from the group consisting of stainless steel, nickel, chromium and combinations thereof.

21. The article of claim 15, wherein said microstructures comprise ceramic.

22. The article of claim 21, wherein said microstructures further comprise metal, said ceramic being disposed on said metal.

23. The article of claim 15, wherein said microstructures comprise glass.

24. The article of claim 23, wherein said microstructures further comprise metal, said glass being disposed on said metal.

25. The article of claim 15, wherein said microstructures have a height no greater than about 250 $\mu$m.

26. The article of claim 1, wherein at least about 120 microstructures/cm$^2$ are disposed between said rigid element and said fixed abrasive element.

27. The article of claim 1, wherein said microstructures have a cross-sectional area of no greater than about 10,000 $\mu$m$^2$.

28. The article of claim 1, wherein said microstructures have a cross-sectional area of no greater than about 50,000 $\mu$m$^2$.

29. The article of claim 1, wherein said microstructure element has no greater than about 20% bearing area.

30. The article of claim 1 wherein said abrasive element comprises a first region comprising structures comprising abrasive particles and a second region free of abrasive particles.

31. The article of claim 1, wherein said fixed abrasive element comprises a textured, fixed abrasive element.

32. The article of claim 1, further comprising a microstructure element comprising said microstructures and a backing, said microstructures being disposed on said backing.

33. The article of claim 1, wherein said rigid element comprises rigid segments.

34. The article of claim 32, wherein said rigid segments extend from a common substrate.

35. An abrasive article comprising:

a) a fixed abrasive element comprising
   i) a backing, and
   ii) a composition disposed on a first major surface of said backing, said composition comprising a binder and a plurality of abrasive particles; and b) a microstructure element bonded to a surface of said abrasive element opposite said abrasive surface, said microstructure element comprising a plurality of microstructures.

36. The article of claim 35, further comprising a rigid element, said microstructure element being bonded to said rigid element.

37. The article of claim 35, further comprising a rigid element, said plurality of microstructures extending from said rigid element.

38. The article of claim 35, wherein said microstructure element comprises a layer substantially coextensive with said fixed abrasive element.

39. The article of claim 35, wherein a cross-section of said microstructures has a shape selected from the group consisting of a polygon, a circle and an ellipse.

40. The article of claim 35, wherein said microstructures are arranged in a pattern.

41. The article of claim 35, wherein said microstructures are arranged in a pattern comprising aligned rows of microstructures.

42. The article of claim 41, wherein said particles comprise polytetrafluoroethylene.

43. The article of claim 35, wherein said microstructures comprise particles disposed in a binder.

44. The article of claim 35, wherein said microstructures comprise a thermoplastic polymer.

45. The article of claim 35, wherein said microstructures comprise a thermoset polymer.

46. The article of claim 35, wherein said microstructures comprise metal.

47. The article of claim 35, wherein said microstructures comprise a metal selected from the group consisting of stainless steel, nickel, chromium and combinations thereof.

48. The article of claim 47, wherein said microstructures further comprise metal, said ceramic being disposed on said metal.

49. The article of claim 35, wherein said microstructures comprise ceramic.

50. The article of claim 35, wherein said microstructures comprise glass.

51. The article of claim 50, wherein said microstructures further comprise metal, said glass being disposed on said metal.

52. The article of claim 35, wherein said microstructures have a height no greater than about 250 $\mu$m.

53. The article of claim 35, wherein said microstructures have a cross-sectional area of no greater than about 10,000 $\mu$m$^2$.

54. The article of claim 35, wherein said microstructures have a cross-sectional area of no greater than about 50,000 $\mu$m$^2$.

55. The article of claim 35, wherein said microstructure element has a no greater than about 20% bearing area.

56. An abrasive article comprising:

a) a fixed abrasive element comprising
   i) a backing, and
   ii) a composition disposed on a first major surface of said backing, said composition comprising a binder and a plurality of abrasive particles; and b) a microstructure element bonded to a surface of said abrasive element opposite said abrasive surface, said microstrctur element comprising a plurality of microstructures and a discontinuous layer.

57. An abrasive article comprising:

a) a fixed abrasive element comprising
   i) a backing, and
   ii) a composition disposed on a first major surface of said backing, said composition comprising a binder and a plurality of abrasive particles; and b) a microstructure element bonded to a surface of said abrasive element opposite said abrasive surface, said microstructure element comprising a first region comprising a first plurality of microstructures having a first dimension, and a second region comprising a second plurality of microstructures having a second dimension.

58. An abrasive article comprising:

a) a fixed abrasive element comprising
   i) a backing, and
   ii) a composition disposed on a first major surface of said backing, said composition comprising a binder and a plurality of abrasive particles; and b) a microstructure element bonded to a surface of said abrasive element opposite said abrasive surface, said microstructure clement comprising a first region comprising a first plurality of microstructures having a first microstructure spacing density, and a second region comprising a second plurality of microstructures having a second microstructure spacing density.

59. An abrasive article comprising:

a) a fixed abrasive element comprising
   i) a backing, and
   ii) a composition disposed on a first major surface of said backing, said composition comprising a binder and a plurality of abrasive particles; and b) a microstructure element bonded to a surface of said abrasive element opposite said abrasive surface, said microstructure element comprising a first region comprising a first plurality of microstructures having a first dimension and a first microstructure spacing density, and a second region comprising a second plurality of microstructures having a second dimension and a second microstructure spacing density.

60. An abrasive article comprising:

a) a fixed abrasive element comprising
i) a backing, and
ii) a composition disposed on a first major surface of said backing, said composition comprising a binder and a plurality of abrasive particles; and b) a microstructure element bonded to a surface of said abrasive element opposite said abrasive surface, said microstructure element comprising a plurality of microstructures;

wherein said microstructures comprise a shape selected from the group consisting of pyramidal, conical, cylindrical, frusto-pyramidal, frusto-conical, frusto-hemispherical and other frusta.

61. An abrasive article comprising:

a) a fixed abrasive clement comprising
i) a backing, and
ii) a composition disposed on a first major surface of said backing, said composition comprising a binder and a plurality of abrasive particles; and b) a microstructure element bonded to a surface of said abrasive element opposite said abrasive surface, said microstructure element comprising a plurality of microstructures; and wherein said microstructures are arranged in a pattern comprising offset rows of microstructures.

62. An apparatus for modifying the surface of a workpiece, said apparatus comprising:

a) a fixed abrasive element;

b) a resilient element;

c) a rigid element disposed between said resilient element and said fixed abrasive element; and d) a plurality of microstructures disposed between said rigid element and said fixed abrasive element.

63. The apparatus of claim 62, wherein said fixed abrasive element is movable relative to said plurality of microstructures.

64. The apparatus of claim 62, wherein said plurality of microstructures and said rigid element are movable relative to said fixed abrasive element.

65. The apparatus of claim 62, further comprising a) a first web comprising said fixed abrasive element;

b) a second web comprising said plurality of microstructures; and c) a third web comprising said resilient element.

66. The apparatus of claim 65, wherein at least one of said first web, said second web and said third web are movable relative to another of said first web, said second web and said third web.

67. The apparatus of claim 65, wherein said second web further comprises said rigid element.

68. The apparatus of claim 62, wherein said microstructures extend from said rigid element.

69. The apparatus of claim 62, wherein said rigid element comprises rigid segments.

70. The apparatus of claim 69, wherein said rigid segments extend from a common rigid substrate.

71. A method of modifying the surface of a semiconductor wafer, said method comprising:

a) contacting the abrasive article of claim 1 with a substrate suitable for the manufacture of semiconductor devices; and b) moving said substrate and said abrasive article relative to each other.

72. The method of claim 71 further comprising:

a) contacting a first region of said abrasive article with said substrate, said first region comprising a first plurality of microstructures having a first cross-sectional area;

b) moving said substrate and said abrasive article relative to each other;

c) contacting a second region of said abrasive article with the substrate, said second region comprising a second plurality of said microstructures having a second cross-sectional area; and d) moving said substrate and said abrasive article relative to each other.

73. The method of claim 72, wherein said abrasive article further comprises a web, said web comprising said plurality of microstructures, said method further comprising indexing said web from a first position to a second position.

74. An abrasive article comprising:

a) an abrasive element comprising a plurality of structures disposed on a first surface of said abrasive element, said structures being at least essentially free of abrasive particles; and b) a plurality of microstructures bonded to a second surface of said abrasive element, said second surface being opposite said first surface; and c) a rigid element, said microstructures being disposed between said rigid element and said abrasive element.

75. The abrasive article of claim 74, further comprising a resilient element, said rigid element being disposed between said resilient element and said abrasive element.

* * * * *

UNITED STATES PATENT AND TRADEMARK OFFICE

CERTIFICATE OF CORRECTION

PATENT NO. : 6,612,917 B2
DATED : September 2, 2003
INVENTOR(S) : Bruxvoort, Wesley J.

It is certified that error appears in the above-identified patent and that said Letters Patent is hereby corrected as shown below:

Column 5,
Line 51, delete "WO 95/224,436," and insert in place thereof -- WO 95/22436 --.

Column 8,
Line 64, delete "young's" and insert in place thereof -- Young's --.

Column 16,
Line 35, delete "microstrctur" and insert in place thereof -- microstructure --.
Line 57, delete "clement" and insert in place thereof -- element --.

Signed and Sealed this

Tenth Day of May, 2005

JON W. DUDAS
*Director of the United States Patent and Trademark Office*